US008622000B2

(12) United States Patent
Meyer

(10) Patent No.: US 8,622,000 B2
(45) Date of Patent: Jan. 7, 2014

(54) ROUNDED CUBIC SHOT AND SHOTSHELLS LOADED WITH ROUNDED CUBIC SHOT

(75) Inventor: Stephen W. Meyer, Glen Carbon, IL (US)

(73) Assignee: Olin Corporation, Clayton, MO (US)

( * ) Notice: Subject to any disclaimer, the term of this patent is extended or adjusted under 35 U.S.C. 154(b) by 0 days.

(21) Appl. No.: 13/422,708

(22) Filed: Mar. 16, 2012

(65) Prior Publication Data

US 2012/0234199 A1 Sep. 20, 2012

Related U.S. Application Data

(60) Provisional application No. 61/453,315, filed on Mar. 16, 2011.

(51) Int. Cl.
*F42B 7/04* (2006.01)

(52) U.S. Cl.
USPC ..... 102/448

(58) Field of Classification Search
USPC ..... 86/57, 54; 102/459, 448, 501, 460, 436, 102/506; 29/33 F, 564; 75/342
See application file for complete search history.

(56) References Cited

U.S. PATENT DOCUMENTS

| | | | | |
|---|---|---|---|---|
| 41,590 | A | 2/1864 | Allen | |
| 111,377 | A | 1/1871 | Paine | |
| 481,074 | A | 8/1892 | Spencer | |
| 487,028 | A * | 11/1892 | Ginalsky | 102/449 |
| 631,703 | A | 8/1899 | Dunn | |
| 1,195,107 | A | 8/1916 | Sheriff | |
| 1,277,810 | A | 9/1918 | Woodhouse | |
| 1,575,716 | A | 3/1926 | Pavek | |
| 1,583,559 | A | 5/1926 | Kenneweg | |
| 1,883,575 | A | 10/1932 | Clyne | |
| 2,343,818 | A | 3/1944 | Sweeley | |
| 2,758,360 | A * | 8/1956 | Shetler | 86/57 |
| 2,767,656 | A | 10/1956 | Zeamer | |
| 3,074,344 | A | 1/1963 | Devaux | |
| 3,131,634 | A | 5/1964 | Freed | |
| 3,204,320 | A * | 9/1965 | Eckstein et al. | 29/899 |
| 3,208,382 | A | 9/1965 | Foote et al. | |
| 3,444,813 | A | 5/1969 | Bird | |
| 3,598,057 | A | 8/1971 | Potter | 102/42 C |
| 3,599,568 | A | 8/1971 | Shellnutt et al. | 102/42 C |
| 3,667,390 | A | 6/1972 | Medin et al. | 102/67 |
| 3,796,157 | A | 3/1974 | Anderson | 102/42 C |
| 3,877,381 | A | 4/1975 | McCoy | 102/92.4 |
| 3,952,659 | A | 4/1976 | Sistino | 102/42 R |
| 3,996,865 | A | 12/1976 | Dwyer | 47/1 R |
| 4,173,930 | A | 11/1979 | Faires, Jr. | 102/42 R |

(Continued)

OTHER PUBLICATIONS

International Preliminary Report on Patentability for corresponding PCT Application No. PCT/US2012/29480, Date Mailed: Jun. 19, 2012, pp. 10.

(Continued)

*Primary Examiner* — Michael Carone
*Assistant Examiner* — Reginald Tillman, Jr.
(74) *Attorney, Agent, or Firm* — Harness, Dickey & Pierce, P.L.C.

(57) ABSTRACT

A shot pellet for a shotshell. The shot pellet has a generally cubic shape comprising six generally square faces joined by rounded edges that have a radius of curvature of between about 15% and 40% of the distance between opposite faces of the generally cubic shaped pellet.

33 Claims, 4 Drawing Sheets

(56) References Cited

U.S. PATENT DOCUMENTS

| | | | | |
|---|---|---|---|---|
| 4,686,904 | A * | 8/1987 | Stafford | 102/439 |
| 4,718,348 | A | 1/1988 | Ferrigno | 102/439 |
| 4,760,793 | A | 8/1988 | Herring, III | 102/460 |
| 4,823,702 | A | 4/1989 | Woolsey | 102/502 |
| 4,913,054 | A | 4/1990 | Petersen | 102/439 |
| 4,982,666 | A | 1/1991 | Wohler | 102/439 |
| 4,996,923 | A | 3/1991 | Theising | 102/438 |
| 5,020,438 | A | 6/1991 | Brown | 102/517 |
| 5,171,934 | A | 12/1992 | Moore | 102/449 |
| 5,325,786 | A | 7/1994 | Petrovich | 102/438 |
| 5,527,376 | A | 6/1996 | Amick et al. | 75/246 |
| 5,648,637 | A | 7/1997 | Clark, III | 102/438 |
| 5,713,981 | A * | 2/1998 | Amick | 75/340 |
| 6,161,482 | A | 12/2000 | Clark | 102/532 |
| 6,202,561 | B1 | 3/2001 | Head et al. | 102/460 |
| 7,357,082 | B1 * | 4/2008 | Racho | 102/439 |
| 7,607,393 | B2 | 10/2009 | Menefee | 102/502 |
| 7,765,933 | B2 | 8/2010 | Poore et al. | 102/460 |
| 7,814,820 | B2 | 10/2010 | Menefee | 86/29 |
| D654,137 | S | 2/2012 | Frank | D22/115 |
| 8,171,849 | B2 * | 5/2012 | Amick | 102/460 |
| 2007/0084375 | A1 | 4/2007 | Smith | 102/450 |
| 2008/0163533 | A1 | 7/2008 | Racho | 42/84 |
| 2008/0286469 | A1 * | 11/2008 | Baumbach et al. | 427/292 |
| 2009/0114113 | A1 | 5/2009 | Poore et al. | 102/460 |
| 2011/0185936 | A1 | 8/2011 | Richardson et al. | 102/438 |
| 2012/0067243 | A1 | 3/2012 | Frank | 102/449 |
| 2012/0204708 | A1 * | 8/2012 | Pearson | 86/57 |

OTHER PUBLICATIONS http://www.outdoorgearbarn.com/p-17916-win-sbs1232-blindside-emg-st1-2510.aspx [Nov. 17, 2011 7:31:10 a.m.].

http://www.skinnymoose.com/moosedroppings/2011/07/19winchester-introduces-new-waterfowl-load-blind-side/[Nov. 17, 2011 7:31:49 a.m.].

* cited by examiner

ROUNDED CUBIC SHOT AND SHOTSHELLS LOADED WITH ROUNDED CUBIC SHOT

CROSS-REFERENCE TO RELATED APPLICATIONS

This application claims priority to U.S. Provisional Patent Application Ser. No. 61/453,315, filed Mar. 16, 2011, the entire disclosure of which is incorporated herein.

FIELD

The present disclosure relates to rounded cubic shot and to shotshells loaded with rounded cubic shot.

BACKGROUND

This section provides background information related to the present disclosure which is not necessarily prior art.

While the shot used in shotshells is conventionally spherical, a wide variety of shapes have been used (U.S. Pat. Nos. 3,877,381 and 4,913,054), including for example discs (U.S. Pat. Nos. 5,648,637 and 6,161,482), cubes (U.S. Pat. No. 4,982,666), needles (U.S. Pat. Nos. 4,996,923 and 5,325,786), pyramids (U.S. Pat. No. 4,686,904), cylinders (U.S. Pat. No. 2,343,818), flattened spheres (U.S. Pat. No. 3,952,659), belted spheres (U.S. Pat. Nos. 5,020,438 and 5,527,376), dimpled spheres (U.S. Pat. No. 4,173,930), tear drops (U.S. Pat. No. 4,718,348), and flechettes (U.S. Pat. Nos. 1,195,107, 3,444,813, and 3,599,568), and even mixtures of sizes (U.S. Pat. Nos. 41,590, 1,277,810, 1,575,716, 1,883,575, 3,074,344, 3,131,634, 3,598,057, and 3,796,157, 4,760,793, and 6,202,561) or shapes (U.S. Pat. Nos. 1,583,559, 3,996,865, 4,823,702, 4,982,666, and 7,607,393, and U.S. Application 20090114113).

However, these shot do not provide the ease of manufacturing, the projectile type, the projectile pattern, or the packing densities advantageously provided by various embodiments of this invention.

SUMMARY

This section provides a general summary of the disclosure, and is not a comprehensive disclosure of its full scope or all of its features.

Prior U.S. Pat. No. 3,952,659, incorporated herein by reference, discusses a flattened spherical shape that is "characterized as standard spherical shot which has been reformed to include six equally spaced, substantially flat faces," and said flat faces "separated from each other by spherical portions." The shot of the preferred embodiment of the present invention is essentially a cube shape with rounded edges and corners. The rounded edges and corners are preferably nearly tangential with the generally square, flat faces that they connect, rather than spherical. Establishing rounded edges and corners on a cube lends itself to easier manufacturing than the shot disclosed in U.S. Pat. No. 3,952,659.

Cubed shaped shot with sharp edges and corners (i.e., a radius approaching zero), that is properly stacked, has a packing density approaching the density of the shot material. As the edge and corner radius of curvature increases, the packing density decreases. When the radius of curvature equals half the cube width, the shot is spherical, and packing density is at a minimum. Cubic shot with no radius of curvature does not flow through metering devices used in automated loading very well (due to frequent bridging) and does not stack properly when charged into a shotshell cartridge. In fact, randomly loaded cubic shot with a small radius of curvature has a lower packing density and greater pattern dispersion than shot with a larger radius of curvature.

Preferred embodiments of shot in accordance with the principles of this invention achieve high packing density coupled with and superior ability to meter. One preferred embodiment of this invention provides a shot pellet for a shotshell that has a generally cubic shape comprising six generally square flat faces joined to adjacent faces by rounded edges having a radius of curvature of between about 15% and about 40%, and more preferably between about 25% and about 35%, of the distance between opposite faces of the generally cubic shaped pellet, with said radii being mostly tangentially rather than spherical. This tangential arrangement results from the radius of curvature not coinciding with the center of the shot. Non-tangential, spherical portions joining circular flat faces as in prior art, can result in pellets that do not meter as well as pellets with nearly tangential radius portions of this invention, due at least in part to sharp edges such as those shown in FIGS. 9 and 10.

Another preferred embodiment of this invention provides a shot pellet for a shotshell having a generally cubic shape comprising six generally square flat faces joined by rounded edges. The surface of the pellets is sufficiently smooth, and the edges being sufficiently rounded so that the pellets have a cylindrical packing density of at least 8% greater than the cylindrical packing density of spherical shot of the same weight.

The generally cubic shape of the shot of the preferred embodiment can provide more disruptive terminal performance on a target compared to rounder shot, such as conventional spherical pellets. Because of its greater packing density, the shot of the preferred embodiment can provide shotshell loadings at higher payloads or higher velocities.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
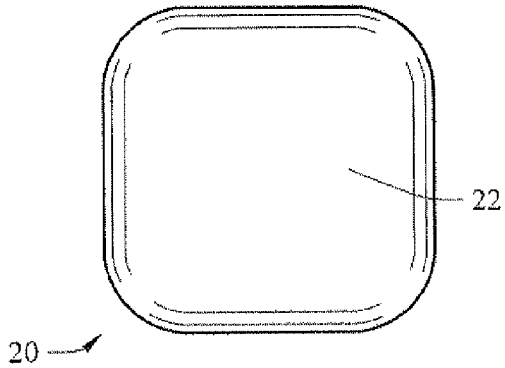
FIG. 1 is a front elevation view of a preferred embodiment of a shot pellet constructed according to the principles of this invention.
Figure 2:
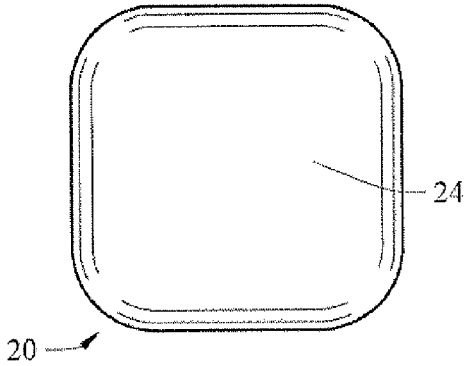
FIG. 2 is a rear elevation view of the shot.
Figure 3:
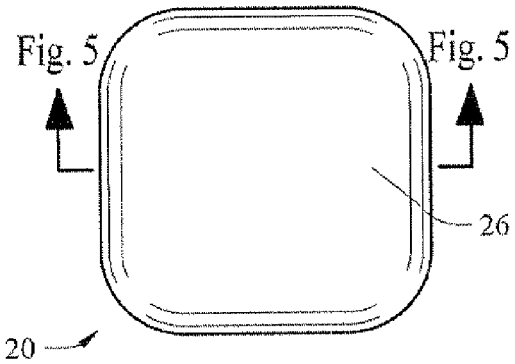
FIG. 3 is a top plan view of the shot.
Figure 4:
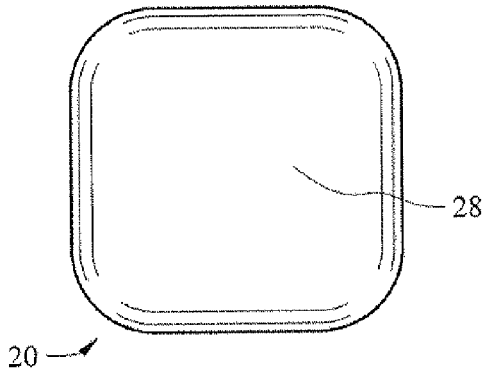
FIG. 4 is a bottom plan view of the shot.
Figure 5:
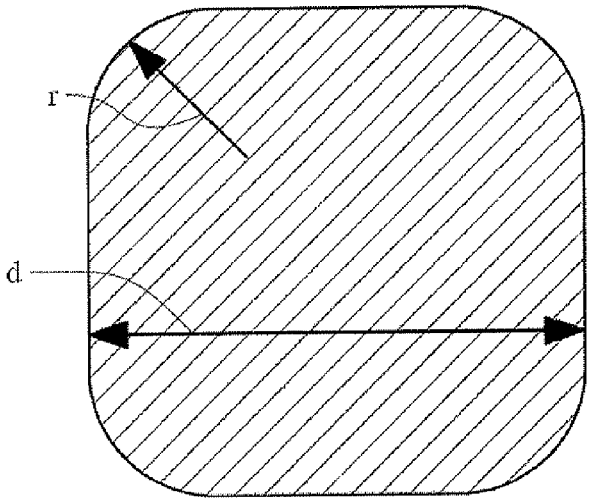
FIG. 5 is a transverse cross-sectional view of the shot taken along the plane of line 5-5 in FIG. 3.
Figure 6:
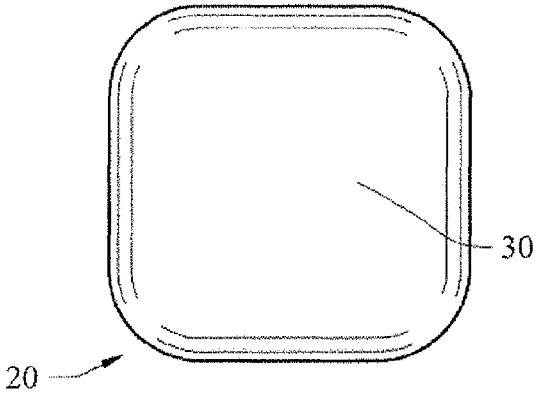
FIG. 6 is a left side elevation view of the shot.
Figure 7:
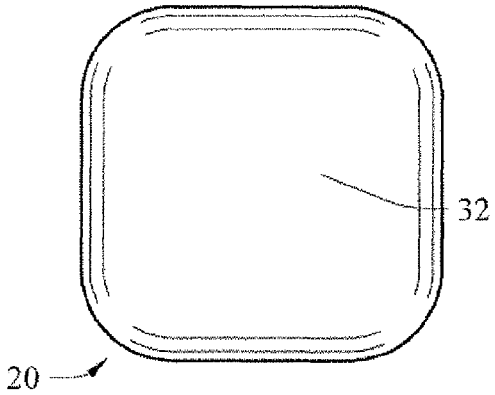
FIG. 7 is a right side elevation view of the shot.

A shot pellet for a shotshell constructed according to the principles of this invention is indicated generally as 20 in FIGS. 1-8. The shot pellet 20 has a generally cubic shape comprising six generally square faces, a front face 22, a rear face 24, a top face 26, a bottom face 28, a left face 30, and a right face 32. As seen in FIG. 5, adjacent generally square faces are joined by rounded edges 34 having a radius (r) of curvature of between 15% and 40% of the distance (d) between faces. Thus, for pellets ranging in size from #9 shot to 000 buckshot, this radius would be between 0.010" to 0.125". Distance (d) between faces of preferred embodiment is less than diameter of a spherical pellet of the same weight, and would be between 0.070" and 0.315" for pellet sizes noted.

The pellets preferably have a mass greater than or equal to a standard #9 shot and less than or equal to a standard 000 Buckshot, or alternatively a mass of between about 1 grain and about 75 grains.

Figure 8:
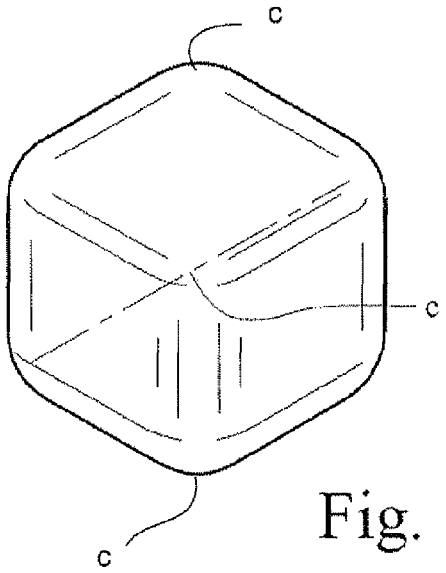
FIG. 8 is a perspective view of the shot.

As seen in FIG. 8, the cube shaped shot 20 has corners (c), with a diagonal distance (CC) from a corner to an opposing corner, which is dependent on distance (d) and radius (r). For a cube with no edge/corner radius, this is equal to: 1.732×d. As edge/corner radius become larger the corner to corner distance reduces. When r=d/2, the corner to corner distance (CC) is the same as the distance d and becomes the diameter of a spherical pellet. For the preferred embodiment, the corner to corner distance $CC=d\sqrt{3}-2r(\sqrt{3}-1)$ This formula is particularly useful in measuring product during shot pellet manufacturing to ensure proper radius r is formed for a pellet of given width d.

Figure 9:
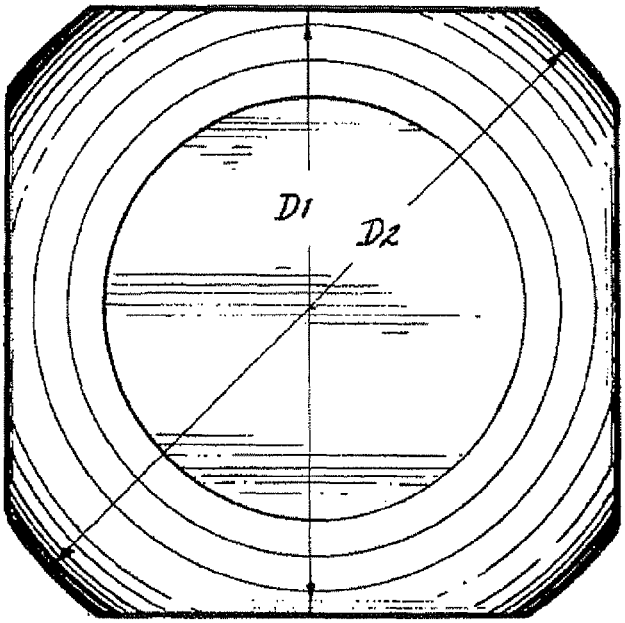
Fig. 9 (Prior Art)
FIG. 9 is a front view of a prior art flattened spherical shot pellet.
Figure 10:
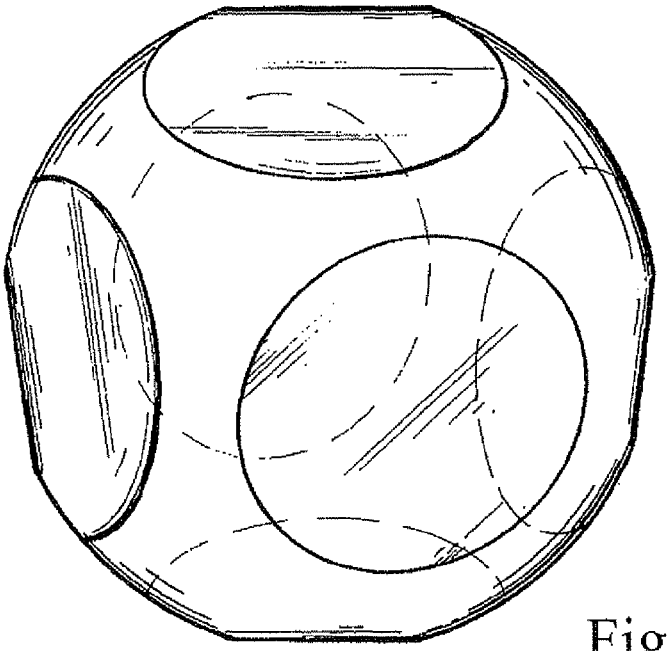
Fig. 10 (Prior Art)
FIG. 10 is an perspective view of the prior art flattened spherical shot.

The prior art shot pellet of U.S. Pat. No. 3,952,659 is shown in FIGS. 9 and 10. The non-tangential, spherical portions joining the circular flat faces of these shot pellets result in poorer flow characteristics in metering equipment compared to pellets of the preferred embodiment. The shot pellets in U.S. Pat. No. 3,952,659 have a pellet width D1 of 0.136" and spherical diameter D2 of 0.163". The spherical radius would be 0.0815", making the ratio of radius to pellet width equal to 60%.

The surface of the shot 20 is preferably smooth, which can contribute to better flight characteristics and distribution patterns when fired from a shotshell. The surface smoothness and rounded edges can make the shot flow and nest better, contributing to the increased packing density. The shot can be plated, for example with yellow zinc chromate, copper, nickel, zinc, chrome, or tin to enhance the smoothness and appearance of the shot.

The shot 20 can be made of any material typically used for ballistic spherical shot, such as lead, tin, tungsten, tungsten composites, copper, bismuth, iron (steel), or alloys/mixtures/composites thereof. The shot 20 is preferably made of steel or stainless steel. The shot can be made by cutting square wire into cubes and rounding the edges, for example by tumbling. Alternatively, the shot can be made by a heading operation between dies.

Figure 11:
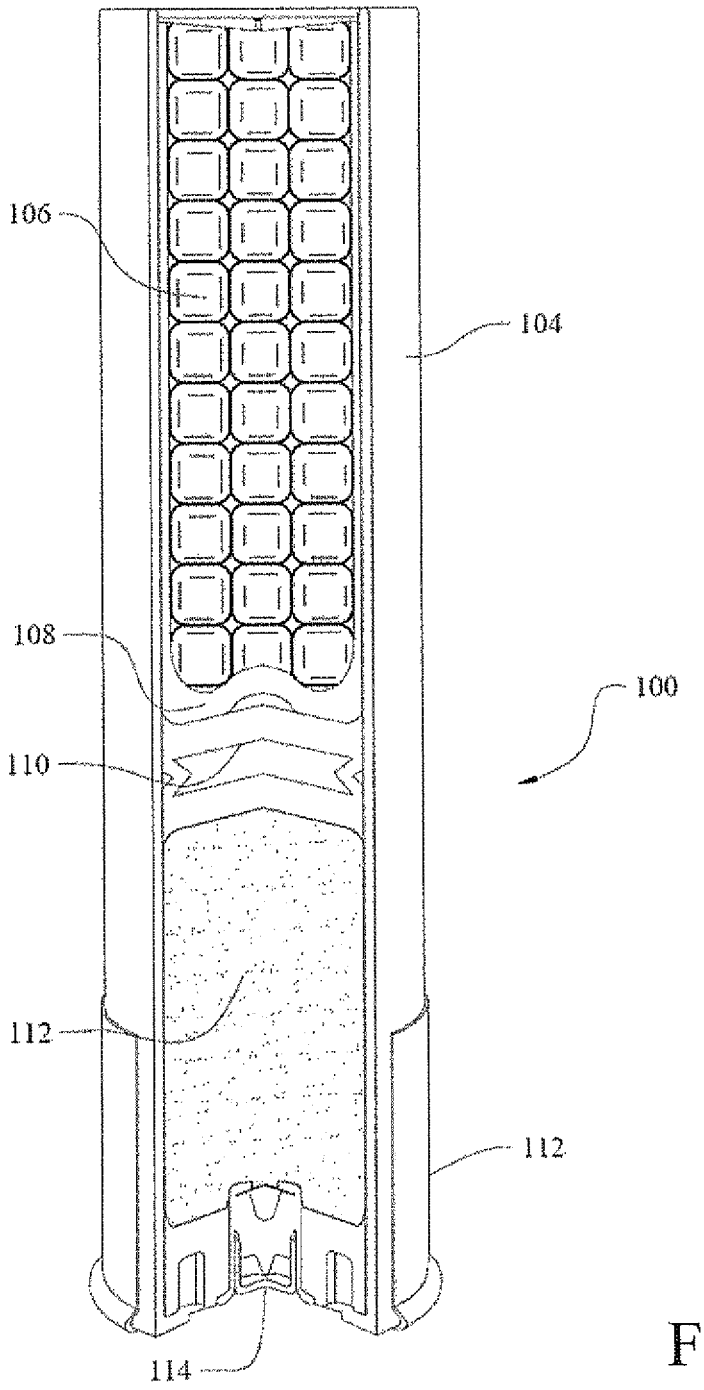
FIG. 11 is a longitudinal cross-sectional view of a shotshell loaded with shot according to a preferred embodiment of this invention.

A 12 gauge shotshell according to another embodiment of this invention is indicated generally as 100 in FIG. 11, loaded with shot according to the preferred embodiments of this invention. The shotshell 100 can generally be of conventional construction with a head 102 and a hull 104. A load of shot 106 (for example shot 20), is contained within a shot cup 108. This shot cup 108 may be the shot cup disclosed in co-pending, co-assigned U.S. patent application Ser. No. 13/233,384, filed Sep. 15, 2011, and shown in U.S. Pat. No. D654137, entitled Shot Cup, issued Feb. 14, 2012, the disclosures of which are incorporated herein by reference. This shot cup 108 can have a plurality of forwardly facing petals that can deploy to separate the shot cup 108 from the load of shot 106 after the shot cup and shot have been discharged from a shot gun.

A wad 110 is disposed in the hull 104 behind the shot cup 108 separating the shot cup from propellant 112. A primer 114 in the head 102 is provided to ignite the propellant 112 when the shotshell 100 is fired.

The shotshell 100 can be of any size and have a wide variety of loads, but some preferred loads are 3½" 12 gauge shell with a 1⅝ ounce load of BB sized shot and 3½ gauge shell with a 1⅜ ounce load of BB sized shot. The shotshell can be loaded for a variety of muzzle velocities, but is preferably load for 1400 fps muzzle velocity.

Table 1 compares the capacity and velocities of shells using embodiments of steel shot of the present invention, with the same sized spherical steel shot:

TABLE 1

| | Exemplary Steel Shot | | Spherical Steel Shot High Velocity | | Spherical Steel Shot Magnum | |
|---|---|---|---|---|---|---|
| Shell type | Number | Payload/ Velocity | Number | Payload/ Velocity | Number | Payload/ Velocity |
| 3½" 12 Gauge BB | 117 | 1⅝ oz. 1400 fps | 108 | 1½ oz 1475 fps | 112 | 1 9/16 oz 1300 fps |
| 3½" 12 Gauge #2 | 203 | 1⅝ oz. 1400 fps | 187 | 1½ oz 1475 fps | 195 | 1 9/16 oz 1300 fps |
| 3 12 Gauge BB | 99 | 1⅜ oz. 1400 fps | 90 | 1¼ oz 1450 | 99 | 1⅜ oz 1300 fps |
| 3 12 Gauge #2 | 172 | 1⅜ oz. 1400 fps | 156 | 1¼ oz 1450 | 172 | 1⅜ oz 1300 fps |

Table 1 shows that the steel shot of embodiments of the present invention allows shotshell loadings at increased payload/pellet count and/or greater velocity compared to loadings using conventional spherical shot.

In terms of performance, as indicated in Table 2, the steel shot embodiments of the present invention, when used with a unique shot cup (e.g., the shot cup disclosed in co-pending, co-assigned U.S. patent application Ser. No. 13/233,384, filed Sep. 15, 2011, and shown in U.S. Pat. No. D654137, the disclosure of which is incorporated herein by reference) achieve pattern densities (number of shot in a given area at a given distance) that exceed spherical shot. The performance will depend upon the choke and the construction of the shotshell, but Table 2 illustrates that embodiments of shot in accordance with the preferred embodiments of the present invention can result in more shot pellets hitting a given area, because more shot pellets can be loaded in the same volume.

TABLE 2

| | Exemplary Steel Shot 1⅜ oz 1400 fps | | Spherical Steel Shot 1¼ oz 1450 fps | |
|---|---|---|---|---|
| Shell type | 40 yards 30 in circle IC | 40 yards 40 in circle IC | 40 yards 30 in circle IC | 40 yards 40 in circle IC |
| 3 12 Gauge BB | 61 | 84 | 50 | 69 |
| 3 12 Gauge #2 | 86 | 126 | 80 | 114 |

Table 3 highlights how edge/corner radius affects various performance characteristics of cube pellets.

TABLE 3

EFFECT OF EDGE RADIUS ON PERFORMANCE

| SIZE | RADIUS | DELTA PACKING DENSITY | ABILITY TO METER |
|---|---|---|---|
| BB | .090 RD (spherical) | 0% BASELINE | ACCEPTABLE |
| BB | 0.040 | +14% | ACCEPTABLE |
| BB | 0.030 | +12% | MARGINAL |
| BB | 0.020 | +6% | POOR |
| BB | 0.005 | −2% | VERY POOR |

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shot pellet for a shotshell, the shot pellet having a generally cubic shape comprising six generally square faces joined by rounded edges having a radius of curvature of between about 15% and about 40% of the distance between opposite faces of the generally cubic shaped pellet, the pellet having a face-to-face dimension of between about 0.070 inches and about 0.315 inches.

2. The shot pellet of claim 1 wherein the pellet has a mass of between about 1 grain and about 75 grains.

3. The shot pellet of claim 1 wherein the pellet has a mass greater than or equal to a standard #9 shot and less than or equal to a standard 000 Buckshot.

4. The shot pellet of claim 1 wherein the pellet has a corner to opposing corner diagonal distance of $d\sqrt{3}-2r(\sqrt{3}-1)$, where d=distance between opposing faces,and r=radius of curvature of rounded edges.

5. The shot pellet of claim 1 wherein the rounded edges have a radius of curvature of between about 25% and about 35% of the distance between opposite faces of the generally cubic shaped pellet.

6. The pellet according to claim 1 wherein the pellet is plated.

7. The pellet according to claim 1 wherein the pellet is plated with yellow zinc chromate, copper, nickel, zinc, chrome or tin.

8. A shotshell loaded with a plurality of the pellets according to claim 1.

9. A shot pellet for a shotshell, the shot pellet having a generally cubic shape comprising six generally square having a face-to-face dimension of between about 0.070 inches and about 0.315 inches faces joined by rounded edges, and having a corner to opposing corner diagonal distance is $d\sqrt{3}-2r(\sqrt{3}-1)$, where d=distance between opposing faces, and r=radius of curvature of rounded edges.

10. The shot pellet of claim 9 wherein the pellet has a mass of between about 1 grain and about 75 grains.

11. The shot pellet of claim 9 wherein the pellet has a mass greater than or equal to a standard #9 shot and less than or equal to a standard 000 buckshot.

12. The shot pellet of claim 9 wherein the rounded edges have a radius of curvature of between about 15% and about 40% of the distance between opposite faces of the generally cubic shaped pellet.

13. A shot pellet for a shotshell, the pellet having a generally cubic shape comprising six generally square faces joined by rounded edges, the pellet having a surface finish of less than $^{63}\sqrt{}$ and a face-to-face dimension of between about 0.070 inches and about 0.315 inches.

14. The shot pellet of claim 13 wherein the pellet has a mass of between about 1 grain and about 75 grains.

15. The shot pellet of claim 13 wherein the pellet has a mass greater than or equal to a standard #9 shot and less than or equal to a standard 000 buckshot.

16. A shot pellet for a shotshell, the pellet having a generally cubic shape comprising six generally square faces joined by rounded edges, and a face-to-face dimension of between about 0.070 inches and about 0.315 inches, the surface of the pellet having a surface roughness sufficiently low that the pellets have a cylindrical packing density of at least 8% greater than the cylindrical packing density of spherical shot of the same mass.

17. The shot pellet according to claim 16 wherein the rounded edges have a radius of curvature of between about 0.01 inches and about 0.125 inches.

18. The shot pellet according to claim 16 wherein the rounded edges have a radius of curvature of between about 15% and about 40% of the distance between opposite faces of the generally cubic shaped pellet.

19. The shot pellet of claim 16 wherein the shot pellet having a generally cubic shape comprising six generally square faces joined by rounded edges, and having a corner to opposing corner diagonal distance is $d\sqrt{3}-2r(\sqrt{3}-1)$, where d=distance between opposing faces, and r=radius of curvature of rounded edges.

20. A shot pellet for a shotshell, the shot pellet having a generally cubic shape comprising six generally square faces joined by rounded edges, and a face-to-face dimension of between about 0.070 inches and about 0.315 inches, the surface of the pellets being sufficiently smooth, and the edges being sufficiently rounded so that the pellets have a cylindrical packing density of at least 8% greater than the cylindrical packing density of spherical shot of the same weight.

21. The shot pellet according to claim 20 wherein the rounded edges have a radius of curvature of between about 0.01 inches and about 0.125 inches.

22. The shot pellet according to claim 20 wherein the rounded edges have a radius of curvature of between about 15% and about 40% of the distance between opposite faces of the generally cubic shaped pellet.

23. The shot pellet of claim 20 wherein the rounded edges have a radius of curvature of between about 25% and about 35% of the distance between opposite faces of the generally cubic shaped pellet.

24. The shot pellet of claim 1 wherein the shot pellet is made of steel.

25. The shot pellet of claim 24 wherein the shot pellet is made of stainless steel.

26. The shot pellet of claim 9 wherein the shot pellet is made of steel.

27. The shot pellet of claim 26 wherein the shot pellet is made of stainless steel.

28. The shot pellet of claim 13 wherein the shot pellet is made of steel.

29. The shot pellet of claim 28 wherein the shot pellet is made of stainless steel.

30. The shot pellet of claim 16 wherein the shot pellet is made of steel.

31. The shot pellet of claim 30 wherein the shot pellet is made of stainless steel.

32. The shot pellet of claim 20 wherein the shot pellet is made of steel.

33. The shot pellet of claim 32 wherein the shot pellet is made of stainless steel.

* * * * *